US005503304A

United States Patent [19]

Keller et al.

[11] Patent Number: 5,503,304

[45] Date of Patent: Apr. 2, 1996

[54] PROTECTIVE SECURITY SYSTEM

[76] Inventors: John F. Keller, 3361 Belvedere Rd., No. 1, West Palm Beach, Fla. 33406; David A. Wilson, 314 Springdale Cir., Palm Spring, Fla. 33461

[21] Appl. No.: 401,589

[22] Filed: Mar. 9, 1995

[51] Int. Cl.[6] ..... B67D 5/64

[52] U.S. Cl. ..... 222/175; 222/630; 222/330; 222/399; 239/154

[58] Field of Search ..... 222/4, 78, 175, 222/630, 637, 330, 394, 399; 224/219; 239/154, 529

[56] References Cited

U.S. PATENT DOCUMENTS

| | | | |
|---|---|---|---|
| 2,555,563 | 6/1951 | Benton | 222/330 X |
| 3,202,318 | 8/1965 | Black | 222/330 X |
| 4,446,990 | 5/1984 | Stevenson et al. | 222/630 X |
| 4,463,879 | 8/1984 | Des Voignes | 222/175 |
| 4,550,861 | 11/1985 | Fay, Sr. et al. | 222/399 X |
| 5,088,624 | 2/1992 | Hackett et al. | 222/78 |

*Primary Examiner*—Gregory L. Huson
*Attorney, Agent, or Firm*—Norman Friedland

[57] ABSTRACT

A separate canister of propellant is operatively connected to a canister housing an noxious chemical or dye that is activated by a spring loaded trigger normally holding a connecting valve closed. The system is affixed to a cuff made from a fabric that wraps around the wrist of the wearer.

6 Claims, 2 Drawing Sheets

PROTECTIVE SECURITY SYSTEM

TECHNICAL FIELD

This invention relates to a portable attack-repellant chemical dispensing system designed to ward off potential attackers and particularly to a protective security system that is adapted to fit on the arm of the wearer and project a wide spray of liquid repellant and/or dye combination.

BACKGROUND ART

There are a plethora of security systems or portable attack repellent chemical devices that are offered on the market or disclosed in the prior art that serve or are designed to protect against potential attacker. For example, U.S. Pat. No. 5,088,624 granted to Hackett et al on Feb. 18, 1994 entitled "Attack-Repellent Device discloses a system adapted to fit on the wrist and includes a housing that appears like a wrist watch and includes one or more nozzles which when activated expels an attack-repellant chemical that is stored in one or more canisters. The U.S. Pat. No. 1,885,180 granted to Cameron on Nov. 1, 1932 entitled "Burglar Ward" is another example of a liquid repellant system intended to be expelled from an orifice when the system is actuated. These, like the many other systems disclosed in the prior art, include the propellent and the noxious liquid or gasses mixed in the same canister or container. In the latter mentioned patent, for example, a glass vile containing an acid such that when the vile is broken it mixes with the liquid and as a result of a chemical reaction a gas is produced and creates sufficient pressure to be expelled from the container or reservoir. As an alternative, an air pump is utilized to pressurize the container and the same sequence of events occurs when the system is activated. The other patent mentioned in the immediate above paragraph likewise uses a canister or a plurality of canisters that contain the liquid repellant or dye or the like and the propellant.

The problem incidental with the aforementioned systems and many of which are available on the current market, is that they do not have the ability to propel the liquid to significant distances and the plume of the spray covers a small area. Another disadvantage of the heretofore known system is that they are relatively complex and hence, prone to malfunction, particularly when they are stored over long periods of time and are not often deployed.

We have found that this invention provides a reusable system without having to replace the propellant after one or two uses that is capable of propelling the noxious chemical and/or a considerable distance and produce a sufficiently wide plume so as to ward off potential attackers.

SUMMARY OF THE INVENTION

An object of this invention is to provide an improved security system to ward off potential attackers.

A feature of this invention is a separate container consisting of a carbon dioxide (CO2) propellant that when activated a gas is emitted through another container containing an appropriate gas and/or dye that is sprayed through a plurality of nozzles for discharging a jet of the gas and/or dye.

Another feature of this invention is that the security system and attendant mechanism is attached to a flexible arm band that attaches to the arm of the wearer for imminent deployment.

The foregoing and other features of the present invention will become more apparent from the following description and accompanying drawings.

DETAILED DESCRIPTION OF THE PREFERRED EMBODIMENT

Figure 1:
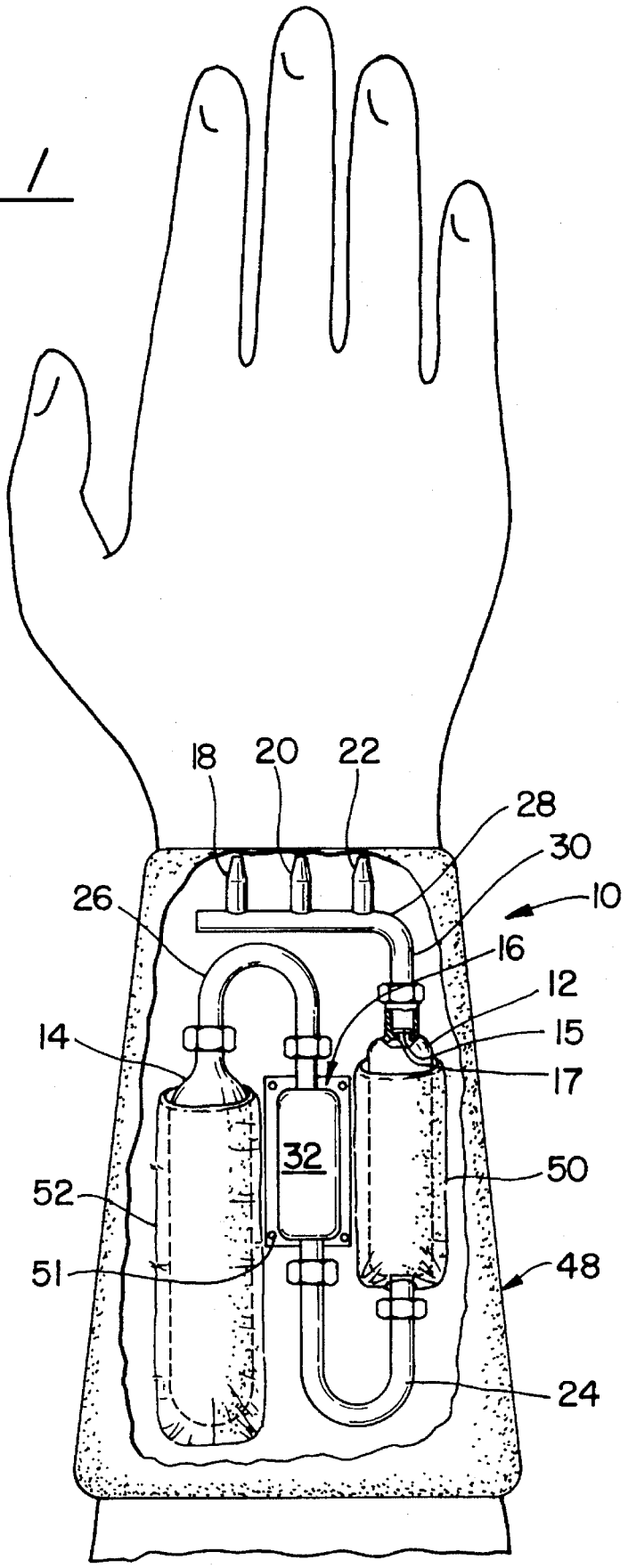
FIG. 1 is a view in elevation illustrating the security system attached to the wrist portion of the wearer.
Figure 2:
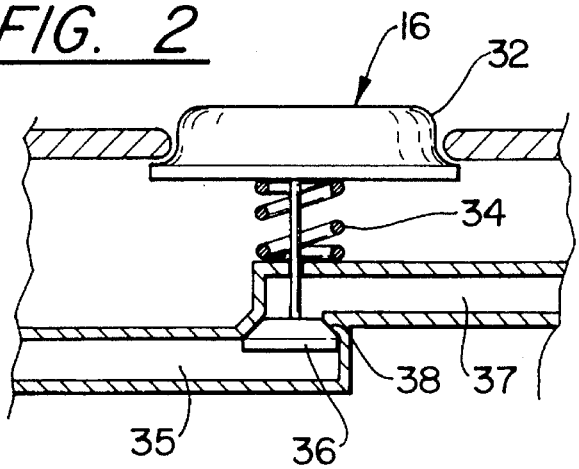
FIG. 2 is a partial view in section illustrating the switching mechanism of the security system of FIG. 1.

While in its preferred embodiment this invention discloses the security system being attached to the wrist of the wearer, as one skilled in this art will appreciate, it can be attached to other portions of the anatomy without departing from the scope of this invention.

The security system generally indicated by reference numeral 10 which is best understood by considering all of the Figs. depicted herein consist of a first canister or container 12 for housing a suitable noxious gas or powder, such as mace or pepper, a second commercially available canister or container 14 housing pressurized or liquid CO2, trigger generally illustrated by reference numeral 16, nozzles 18, 20 and 22 and suitable connecting conduits or lines, to be described hereinbelow. Canister 12 is normally held closed by any suitable means such as the resilient elastomeric self actuating flap 15 overlying the orifice 17. When pressure builds up sufficiently in canister 12 by virtue of the CO2 bottle, the flap opens allowing the noxious gas and/or dye to flow to the manifold and then through the nozzles 18, 20 and 22.

Figure 3:
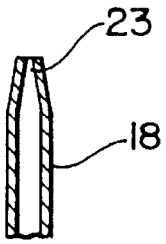
FIG. 3 is a partial view illustrating the nozzle of the security system of FIG. 1.
Figure 4:
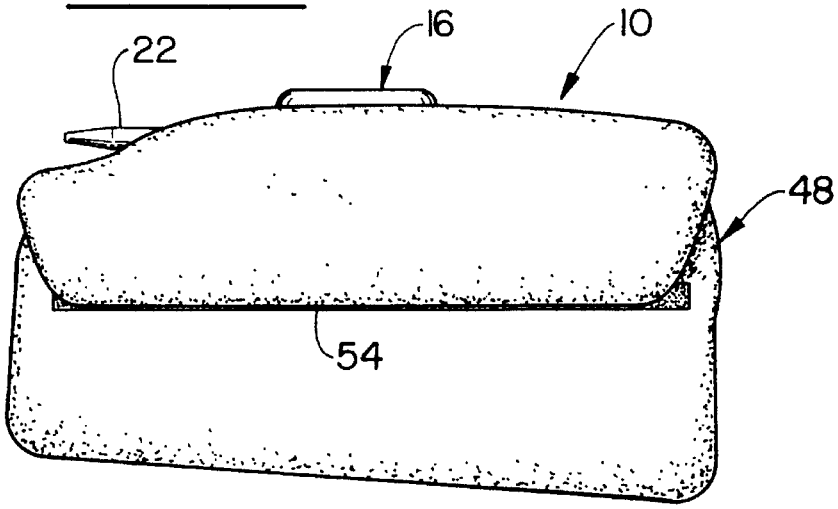
FIG. 4 is a plan view of the arm band of the security system of FIG. 1.
Figure 5:
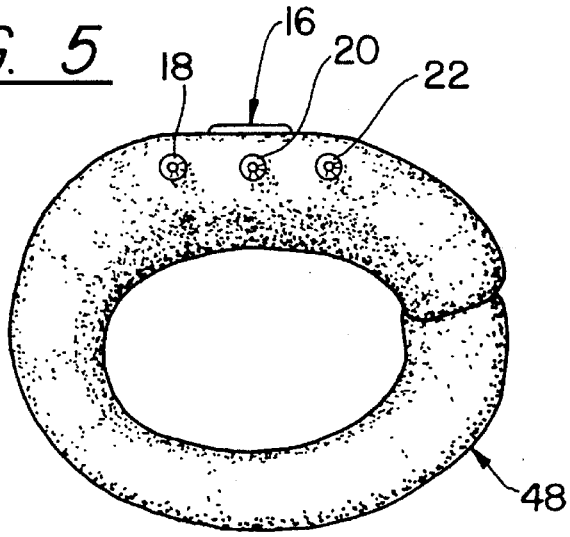
FIG. 5 is an end view of the arm band of FIG. 4.

As noted in FIG. 1 the canister 12 is connected to the trigger 16 via line 24 and the canister 14 is connected to the trigger 16 via line 26 and the nozzles 18, 20 and 22 are connected to the canister 12 via the manifold 28 and line 30. In operation, the plunger 32 of trigger 16 is depressed to force the plunger stem 34 to position the valve 36 away from valve seat 38. The helical spring 40 serves to bias plunger 32 in the upward position as viewed in the drawing and close valve 36. Obviously, the valve remains closed until the trigger 16 is activated. Upon activation, the trigger effectively communicates the CO2 in canister 14 with the noxious gas or powder in canister 12, via lines 26, 24, passage 35 and passage 37 which, in turn, pressurizes the mixture of the gasses and other substance to cause the normally closed flap 15 to open and allow the gasses to flow to nozzles 18, 20 and 22 via line 30 and manifold 28. The nozzles 18, 20 and 22 as depicted in FIG. 3 include a relatively small orifice 23 that constricts the flow and creates a jet stream for emitting the substance forward. Since, the pressure of the CO2 is relatively high, the jets emanating from orifices 23 from the nozzles 18, 20 and 22 which serve to propel the substance a considerable distance and owing to the number of jets (more or less can be included, depending on the particular application or end use, a relatively large plume is effectuated.

The security system includes a cuff or holder 48 made from a suitable fabric that supports the hardware of the security system. While any suitable supporting construction may be utilized, as disclosed herein, the canisters 12 and 14 are supported in suitable pockets 50 and 52 sewn into cuff 48. The trigger 16 is affixed to the cuff 48 by suitable commercially available grommets 51. The cuff 48 is a generally flat rectangular shaped member that is wrapped around the wrist as shown in FIG. 1. The end of the flat member includes a flap 54 that attaches by any suitable means such as Velcro strips, zipper, snaps or buttons. As shown a male or hook Velcro strip is suitably attached to the inner face of flap 54 and the complementing loop strip is suitably attached to the outer face of the cuff 48, as shown. Obviously, the Velcro attachment fits all size wrists and allows the wearer to tighten the cuff 48 to meet the wearers's needs and comfort.

Although this invention has been shown and described with respect to detailed embodiments thereof, it will be appreciated and understood by those skilled in the art that various changes in form and detail thereof may be made without departing from the spirit and scope of the claimed invention.

We claim:

1. A security protective system adapted to be worn by the user so as to propel a noxious chemical and/or dye to ward off a potential attacker including a first canister, a second canister and means for interconnecting said first canister and said second canister including a normally closed valve means, a trigger operatively connected to said valve means for actuating said valve means to the opened position to interconnect said first canister with said second canister, a plurality of nozzles and a manifold interconnecting each of said plurality of nozzles, said manifold fluidly connected to said first canister, said first canister housing a noxious chemical and/or dye, said second canister housing pressurized carbon dioxide propellant, whereby opening of said valve causes the flow of said propellent into said second canister and the flow of said noxious chemical and/or dye into said manifold and through said nozzles for propelling said noxious chemical and/or dye in a forward direction.

2. A security protective system as claimed in claim 1 including, a cuff having a top face and a bottom face and opposing ends made from a foldable fabric material for wrapping around the wrist of the user, and means for attaching said security protective system to said cuff.

3. A security protective system as claimed in claim 2 wherein said cuff includes a pair of pockets attached to said top face, said first canister being supported in one of said pair of pockets and said second canister being supported in the other of said pair of pockets.

4. A security protective system as claimed in claim 3 wherein one end of said cuff defines a flap for overlapping said top face and means for securing said flap to said top face for holding said security protective system to the wrist of the user.

5. A security protective system as claimed in claim 4 wherein said plurality of nozzles includes three nozzles.

6. A security protective system as claimed in claim 5 wherein said means for securing said flap includes a Velcro® strap.

* * * * *